US006590328B2

(12) United States Patent
Shin et al.

(10) Patent No.: US 6,590,328 B2
(45) Date of Patent: Jul. 8, 2003

(54) TENSION MASK FRAME ASSEMBLY FOR COLOR CATHODE RAY TUBE

(75) Inventors: Soon-Cheol Shin, Suwon (KR); Sang-Shin Choi, Suwon (KR); Woo-Il Park, Hwasung-gun (KR); Il-Hwan Jang, Seoul (KR); Eung-Suk Lee, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 177 days.

(21) Appl. No.: 09/925,039

(22) Filed: Aug. 9, 2001

(65) Prior Publication Data

US 2002/0063507 A1 May 30, 2002

(30) Foreign Application Priority Data

Nov. 25, 2000 (KR) ..... 2000-70632

(51) Int. Cl.[7] ..... H01J 29/80

(52) U.S. Cl. ..... 313/407; 313/269; 313/402; 313/403; 313/404

(58) Field of Search ..... 313/402, 403, 313/404, 406, 407, 269, 405, 408

(56) References Cited

U.S. PATENT DOCUMENTS 4,942,332 A 7/1990 Adler et al.
5,111,107 A 5/1992 Kume et al.
6,469,431 B1 * 10/2002 Suzuki et al. ..... 313/407

FOREIGN PATENT DOCUMENTS

EP 984 482 A2 3/2000
JP 2000-77007 3/2000

* cited by examiner

*Primary Examiner*—Nimeshkumar D. Patel
*Assistant Examiner*—Sharlene Leurig
(74) *Attorney, Agent, or Firm*—Robert E. Bushnell, Esq.

(57) ABSTRACT

A tension mask frame assembly for a color cathode-ray tube, including a tension mask, a frame and a vibration prevention unit, is provided. In this tension mask frame assembly, the tension mask has a slotted portion in which a plurality of electron beam passing holes are formed and a non-slotted portion located on the edge of the slotted portion. The frame supports two facing sides of the tension mask to apply a tensile force to the tension mask. The vibration prevention unit includes a damper having first and second attenuation portions that are maintained at a predetermined angle to form an insertion portion into which the edges of the tension mask not supported by the frame are inserted, and a support member for suspending the damper from the edges of the tension mask by passing through the first and second attenuation portions and the edges of the tension mask inserted into the insertion portion formed by the first and second attenuation portions.

27 Claims, 10 Drawing Sheets

TENSION MASK FRAME ASSEMBLY FOR COLOR CATHODE RAY TUBE

CLAIM OF PRIORITY

This application makes reference to, incorporates the same herein, and claims all benefits accruing under 35 U.S.C. §119 from an application entitled Tension Mask Frame Assembly for Color Cathode Ray Tube earlier filed in the Korean Industrial Property Office on Nov. 25, 2000, and there duly assigned Ser. No. 2000-70632 by that Office.

BACKGROUND OF THE INVENTION

1. Field of the Invention

The present invention relates to color cathode-ray tubes, and more particularly, to a tension mask frame assembly for a color cathode-ray tube, having an improved structure capable of attenuating the vibrations of a tension mask supported by a frame.

2. Description of the Background Art

A color cathode-ray tube includes three electron beams emitted from an electron gun installed on a neck portion of a funnel and land on the red, green and blue fluorescent materials on a fluorescent film formed on the inner surface of a panel sealed by the funnel, through electron beam pass holes in a mask having a color distinction function, and excite the fluorescent materials, whereby a picture is formed.

Color cathode-ray tubes as described above pursue a flat screen surface to widen the viewing angle of viewers and prevent distortion of pictures, which requires flattening of a mask that is installed within a cathode-ray tube and performs a color distinction function. This mask becomes an obstacle in manufacturing completely-flat cathode-ray tubes.

A general tension mask frame assembly includes a frame and a flat tension mask. The frame has first and second support members that are parallel, and first and second elastic members, the ends of which are secured to the first support member and the second support member, to maintain an equal distance between the first and second support members. The flat tension mask has the facing longer sides welded to the first and second support members so that tension is applied to the first and second support members. The tension mask is made up of a slotted portion in which a plurality of electron beam pass holes are formed and a non-slotted portion extending from the edge of the slotted portion.

In this tension mask frame assembly, only the longer sides of the non-slotted portion of the tension mask are secured to the first and second support members, so that the shorter sides of the tension mask are free in direction Y perpendicular to the length direction X, that is, in a vertical direction with respect to one side of the tension mask. Thus, the tension mask supported by the frame is vibrated by external impacts or the sound pressure of a speaker, which causes mislanding that electron beams do not accurately land on a fluorescent film. Mislanding causes light emitting from a wrong fluorescent material by electron beams, resulting in a picture having a non-uniform resolution. In particular, since the inside of a cathode-ray tube is a vacuum, the vibration of a mask lasts for a long duration because of the lack of the resistance of air. Thus, a damper operation to rapidly vanish vibrations by changing vibration energy into another type of energy is required.

Exemplars of the art are U.S. Pat. No. 4,942,332 issued to Adler et al. for Tied Slit Mask for Color Cathode Ray Tubes disclosing a slit-typed tension mask, and U.S. Pat. No. 5,111,107 issued to Kume et al for Grid Apparatus for a Color Cathode Ray Tube which Eliminates Vibration of the Grids disclosing a tension mask frame assembly.

A conventional tension mask frame assembly by which vibrations are reduced using this damper operation is disclosed on Japanese Patent Publication No. 2000-77007 by Suzuki for Color Cathode-ray Tube. In a seventh tension mask resonance mode or below, this tension mask frame assembly has a structure in which the amplitude of the shorter side of a tension mask is relatively constant to the amplitude of the center of the tension mask, and vibrations are reduced by fastening a non-slotted portion at the shorter side of the tension mask with clips or rings.

SUMMARY OF THE INVENTION

It is therefore an objective of the present invention to provide a tension mask frame assembly for a color cathode-ray tube, that can increase the vibration attenuation effect by attenuating the vibration energy generated by non-elastic collision at the edge of the end of a tension mask supported by a frame, and can prevent picture jitter and improve the resolution by preventing mislanding of electron beams on a fluorescent film.

It is another object to have an increased stability in the picture quality of a cathode-ray tube.

It is yet another object to have a tension mask and a tension mask frame assembly that increase the stability of the picture without increasing the complexity and cost of manufacturing a cathode-ray tube.

It is still yet another object to have a cathode-ray tube that reduces vibration in a tension mask and yet be easy to manufacture.

To achieve the above objectives, the present invention provides a tension mask frame assembly for a color cathode-ray tube, including a tension mask having a slotted portion in which a plurality of electron beam passing holes are formed and a non-slotted portion located on the edge of the slotted portion, a frame for supporting two facing sides of the tension mask to apply a tensile force to the tension mask, and a vibration prevention unit including a damper having first and second attenuation portions that are maintained at a predetermined angle to form an insertion portion into which the edges of the tension mask not supported by the frame are inserted, and a support member for suspending the damper from the edges of the tension mask by passing through the first and second attenuation portions and the edges of the tension mask inserted into the insertion portion formed by the first and second attenuation portions.

In the tension mask frame assembly, the damper is formed by folding a plate-shaped member. The inner surface of each of the first and second attenuation portions linearly contact the end of the non-slotted portion of the tension mask. The insertion portion becomes narrower from its entrance toward its inside. A folded portion close to both side surfaces of the non-slotted portion is formed by folding the ends of the first and second attenuation portions at the side through which the non-slotted portion of the tension mask is inserted, in opposite directions.

The present invention also provides a tension mask frame assembly for a color cathode-ray tube, including a frame including first and second support members isolated from each other at a predetermined interval and at least a pair of elastic members, the ends of which are secured to the first and second support members, for supporting the first and second support members, a tension mask having a plurality of strips isolated from each other at a predetermined interval for forming slots and a plurality of real bridges installed between adjacent strips for partitioning a slot by connecting the adjacent strips to each other, where the longer sides of the tension mask perpendicular to the length direction of the strips are supported by the first and second support members such that a tensile force is applied to the plurality of strips, and a vibration prevention unit including a damper having first and second attenuation portions located at both sides of the edge of the tension mask for forming an insertion portion into which the edge of the tension mask is inserted, and at least one support member for suspending the damper from a non-slotted portion of the tension mask inserted into the insertion portion by passing through the first and second attenuation portions and the non-slotted portion.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
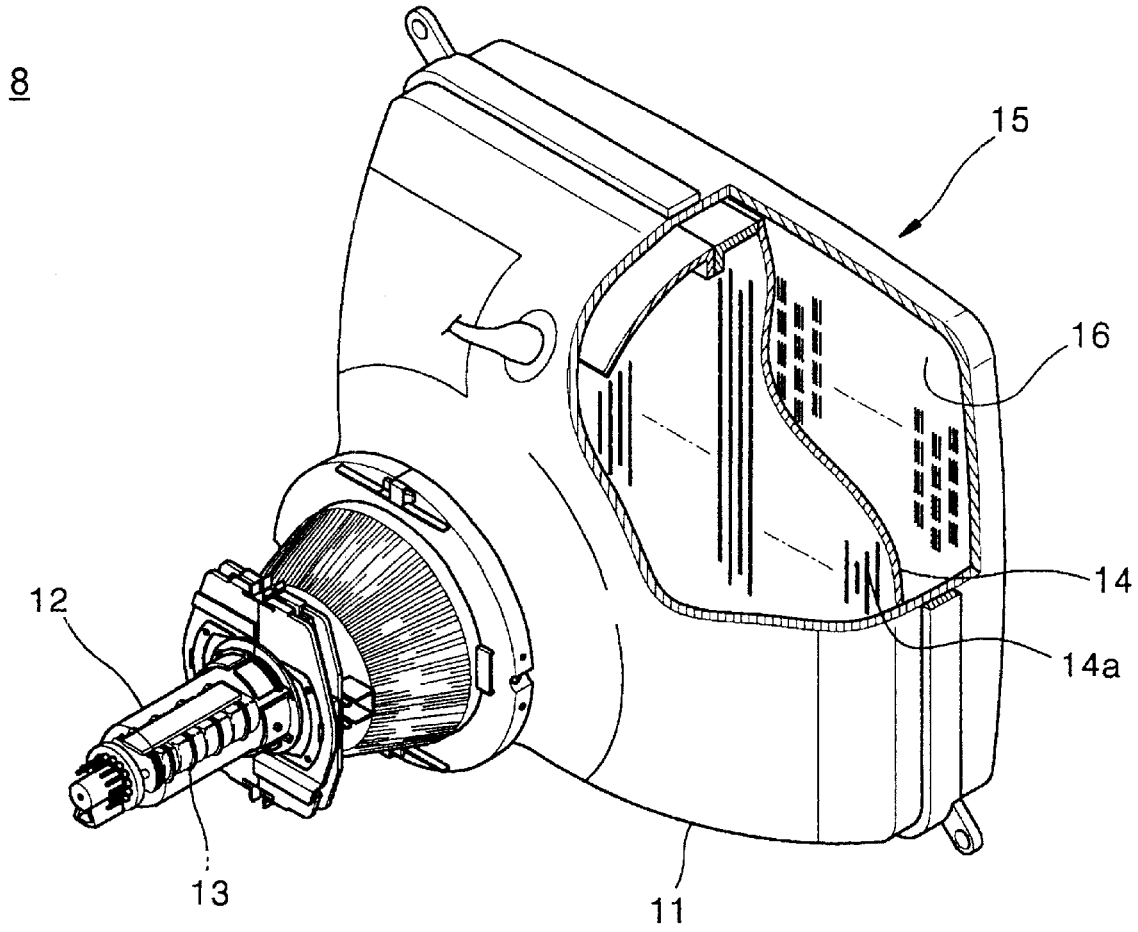
FIG. 1 is a partially-open perspective view of a general cathode-ray tube.

Turning now to the drawings, as shown in FIG. 1, in a color cathode-ray tube, three electron beams emitted from an electron gun 13 installed on a neck portion 12 of a funnel 11 land on the red, green and blue fluorescent materials on a fluorescent film 16 formed on the inner surface of a panel 15 sealed by the funnel 11, through electron beam pass holes 14*a* in a mask 14 having a color distinction function, and excite the fluorescent materials on the fluorescent film 16, whereby a picture is formed.

Figure 2:
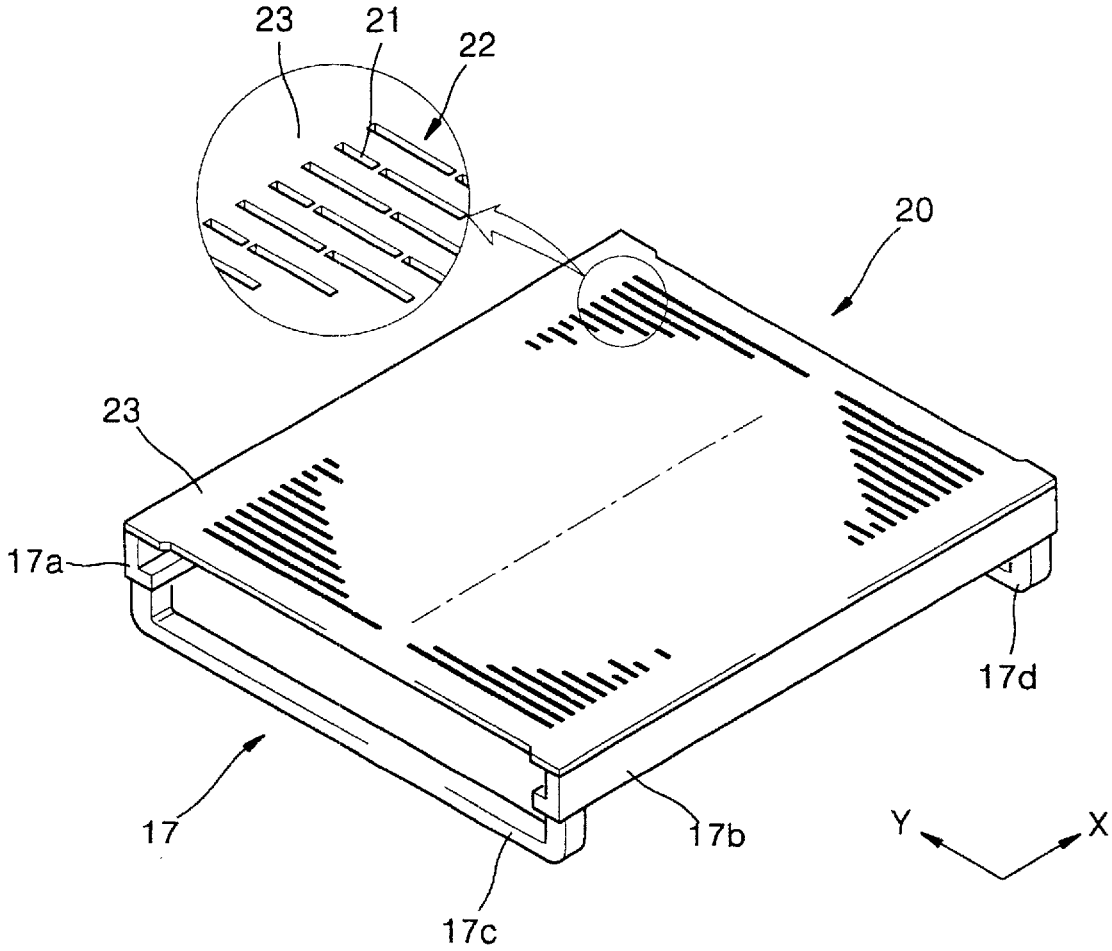
FIG. 2 is a perspective view of an earlier tension mask frame assembly.

As shown in FIG. 2, the disclosed general tension mask frame assembly includes a frame 17 and a tension mask 20. The frame has first and second support members 17*a* and 17*b* which are parallel, and first and second elastic members 17*c* and 17*d*, the ends of which are secured to the first support member 17*a* and the second support member 17*b*, to maintain an equal distance between the first and second support members 17*a* and 17*b*. The tension mask 20 has the facing longer sides welded to the first support member 17*a* and second support member 17*b* so that tension is applied to the first and second support members 17*a* and 17*b*. The tension mask 20 is made up of a slotted portion 22 in which a plurality of electron beam pass holes 21 are formed and a non-slotted portion 23 extending from the edge of the slotted portion.

In this tension mask frame assembly, only the longer sides of the non-slotted portion 23 of the tension mask 20 are secured to the first and second support members 17*a* and 17*b*, so that the shorter sides of the tension mask 20 are free in direction Y perpendicular to the length direction X, that is, in a vertical direction with respect to one side of the tension mask. Thus, the tension mask supported by the frame 17 is vibrated by external impacts or the sound pressure of a speaker, which causes mislanding of electron beams in that the electron beams do not accurately land on a fluorescent film.

Figure 3:
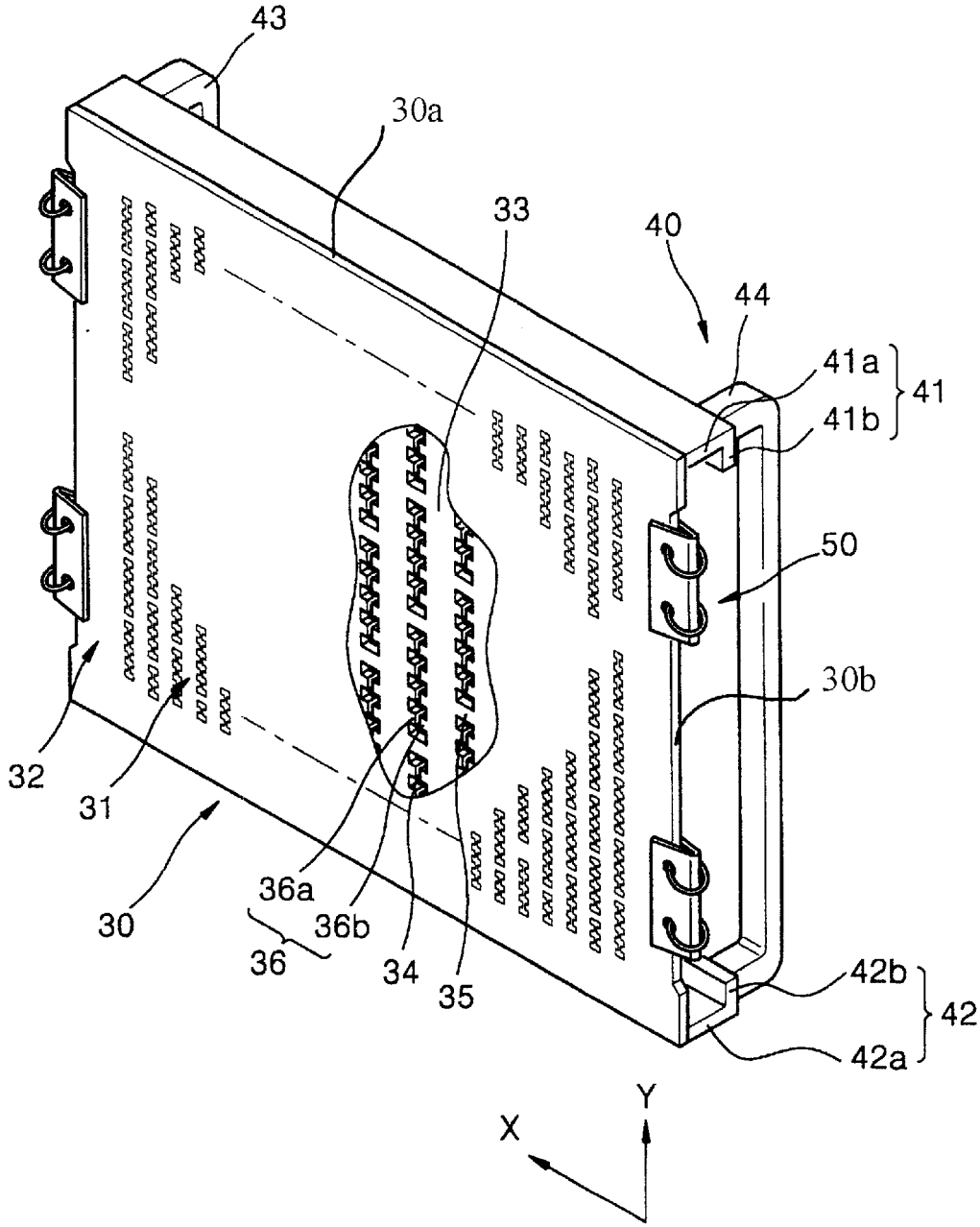
FIG. 3 is a perspective view of a tension mask frame assembly according to an embodiment of the present invention.
Figure 4:
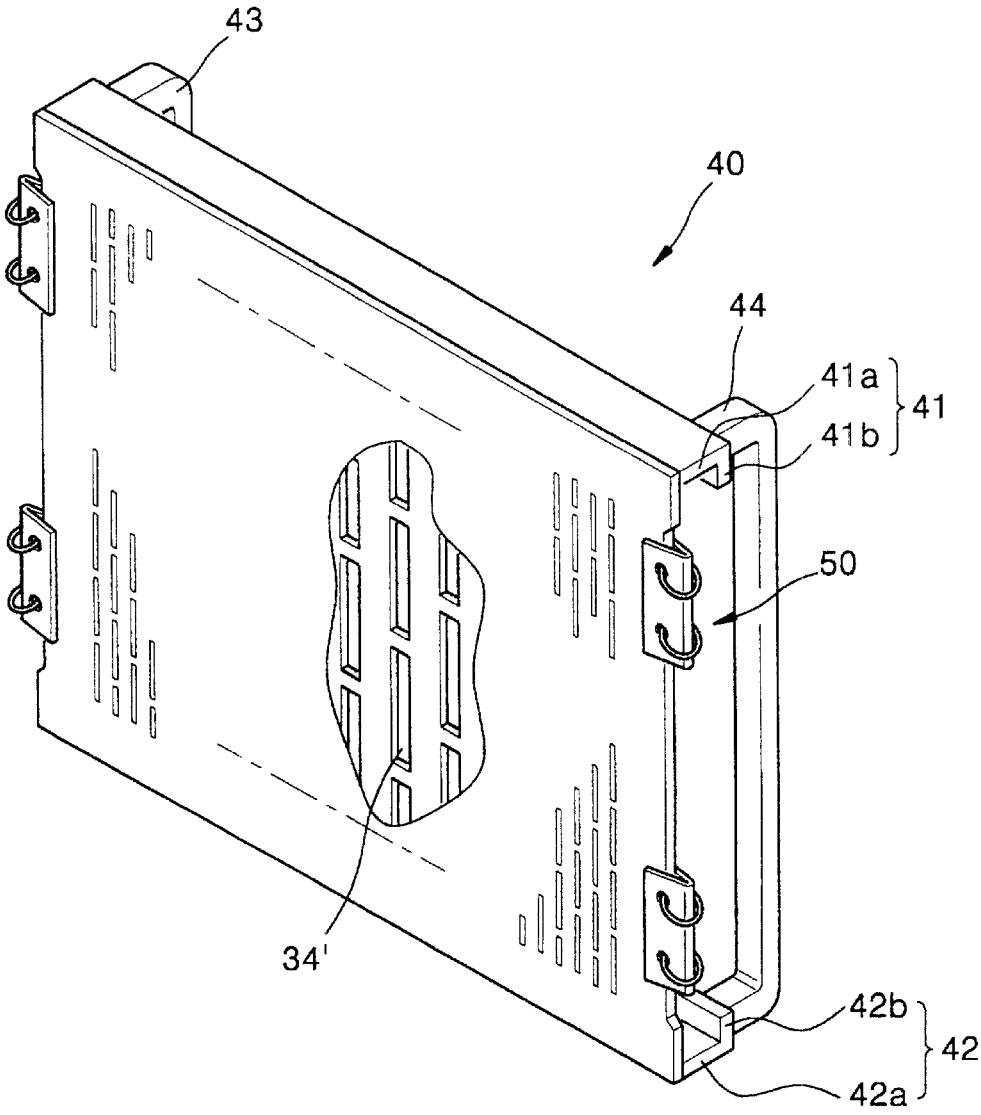
FIG. 4 is a perspective view of a tension mask frame assembly according to another embodiment of the present invention.
Figure 5:
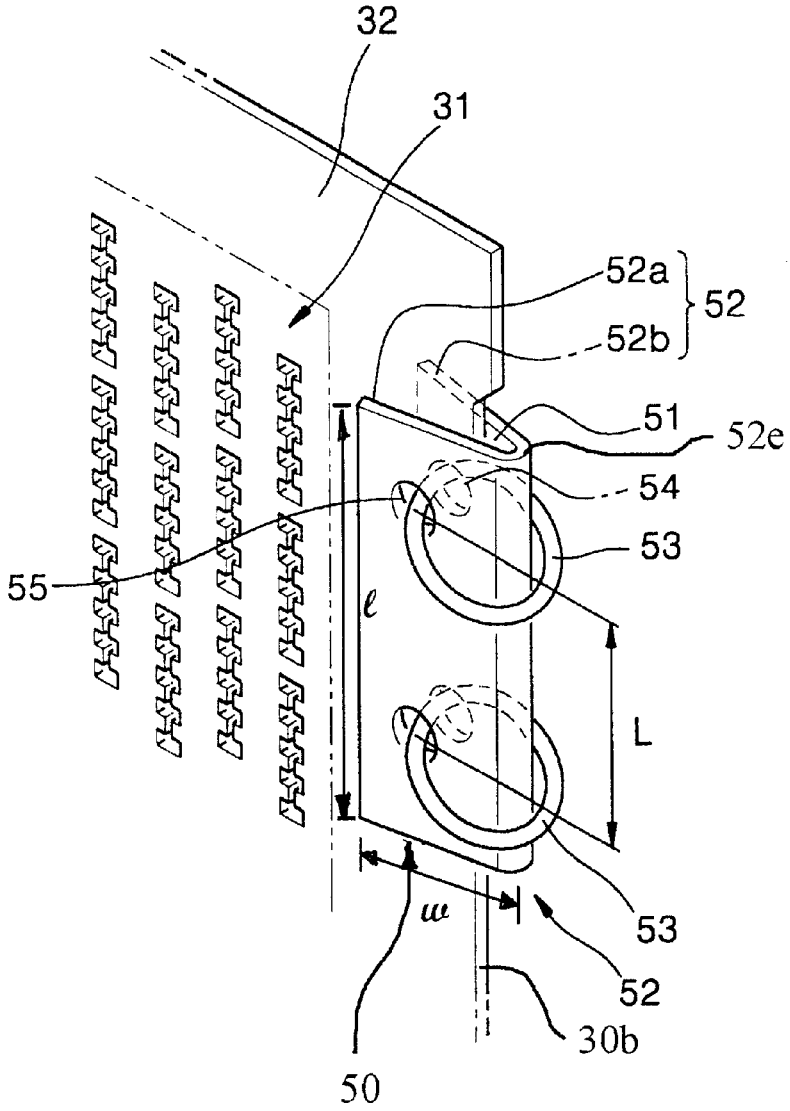
FIG. 5 is a magnified view for illustrating the vibration prevention unit shown in FIG. 3.

As shown in FIGS. 3 and 5, the tension mask frame assembly includes a tension mask 30 having electron beam passing holes (slots or dot-shaped through holes), a frame 40 for supporting the longer sides of the tension mask 30 so that a uniform tensile force is applied to the tension mask 30 in one direction (hereinafter, referred to as direction Y), and a vibration prevention member 50 contacting the shorter sides of the tension mask 30 for preventing vibrations of a tension mask.

The frame 40 includes first and second support members 41 and 42 that are isolated from each other at a predetermined interval, and a pair of first and second elastic members 43 and 44, the ends of which are supported by the first and second support members 41 and 42. The first and second support members 41 and 42 include securing portions 41*a* and 42*a*, respectively, and flange portions 41*b* and 42*b*, respectively, extending inward from the bottom end of the securing portions 41*a* and 42*a*.

The frame 40 having the first and second support members 41 and 42 and the first and second elastic members 43 and 44 for supporting them has been described as an example, but the present invention is not limited to this example. The frame 40 can have any structure capable of applying a tensile force to the tension mask in the direction Y. Alternatively, the elastic members for supporting the first and second support members can have both ends secured to the inside isolated a predetermined distance from the ends of the first and second support members in order to equalize a support force for supporting the first and second support members so that a tensile force is applied to the tension mask.

The tension mask 30 is subjected to a tensile force since its longer sides 30*a* are secured 18 to the first and second securing portions 41*a* and 42*a* of the frame 40 configured as described above. 19 This tension mask 30 includes a slotted portion 31 having a plurality of electron beam passing holes 34 and a non-slotted portion 32 at the edge of the slotted portion 31. In the slotted portion 31 of the tension mask 30, as shown in FIG. 3, electron beam passing holes, that is, slots 34, are formed by a plurality of strips 33 isolated from each other at predetermined intervals. Real bridges 35 are installed between adjacent strips 33 to connect them to each other, thereby partitioning the slot 34. Dummy bridges 36 each made up of protrusions 36*a* and 36*b* extending from adjacent strips 33 in opposite directions are formed on the partitioned slot 34. The shape of the tension mask is not limited to this embodiment. For example, as shown in FIG.

4, the slotted portion can have vertically-long slots 34' formed in a predetermined pattern. Alternatively, though not shown in the drawings, the slotted portion can have dot-shaped electron beam pass holes formed in a predetermined pattern.

Referring to FIG. 5, the vibration prevention unit 50 is used to attenuate vibrations of a tension mask generated by external impacts or the sound pressure of a speaker, and includes a damper 52 and at least one support member 53. The damper has an insertion portion 51 into which the non-slotted portion at the shorter side 30*b* of the tension mask 30 is inserted. The support member 53 suspends the damper 52 from the non-slotted portion 53 by passing through the damper 52 and the non-slotted portion 53.

The damper 52 is formed by folding a thin plate lengthwise forming a bent portion 52*e*, and including first and second attenuation portions 52*a* and 52*b* that form an insertion portion 51 into which the non-slotted portion 32 at the shorter sides of the tension mask is inserted. The first and second attenuation portions 52*a* and 52*b* are obtained by folding a thin plate lengthwise, so that their bases are connected at the fold (52*e*) and the cross section of the connected structure is clamp-shaped. The first and second attenuation portions 52*a* and 52*b* has at least one first and second through holes 54 and 55, respectively, and their inner surfaces are knurled and embossed to increase the friction contact resistance against the non-slotted portion 32, resulting in a high surface roughness. Preferably, the damper having such a configuration is 100 millimeters in length l, and the first and second attenuation portions 52*a* and 52*b* have 5 millimeters widths w. Also, if each of the first and second attenuation portions 52*a* and 52*b* has two through holes, it is preferable that they are isolated a length L of 80 millimeters from each other.

The support member 53 perforates through the first and second through holes 54 and 55 formed in the first and second attenuation portions 52*a* and 52*b*, respectively, of the damper 52 and a combination hole 56 formed in the non-slotted portion 32 in order to combine the damper with the non-slotted portion, so that the damper is suspended from the non-slotted portion. The support member 53 is shaped of a wire-bended ring having a predetermined diameter, but it is not limited to this shape. Preferably, the diameters of the combination hole 56 and the first and second through holes 54 and 55 formed in the first and second attenuation units 52*a* and 52*b* are 1.2 to 15 times the diameter of the support member 53 so that the ring-shaped support member 53 and the damper 52 suspended from the non-slotted portion 32 of the tension mask are sufficiently free.

Figure 6:
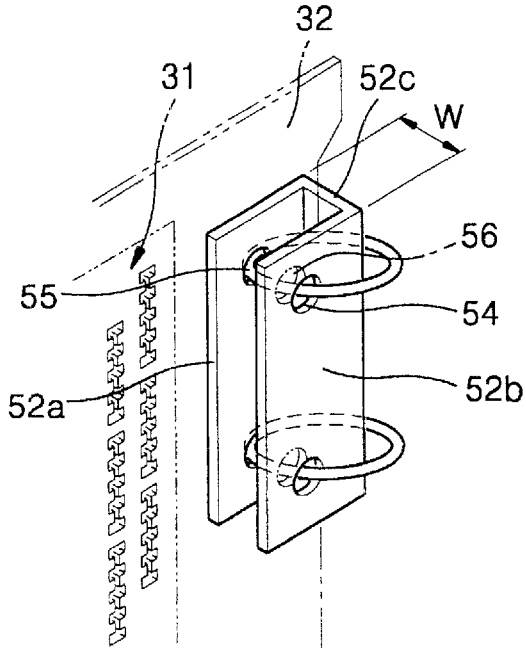
FIGS. 6 through 11 show other embodiments of a vibration prevention unit according to the present invention.
Figure 7:
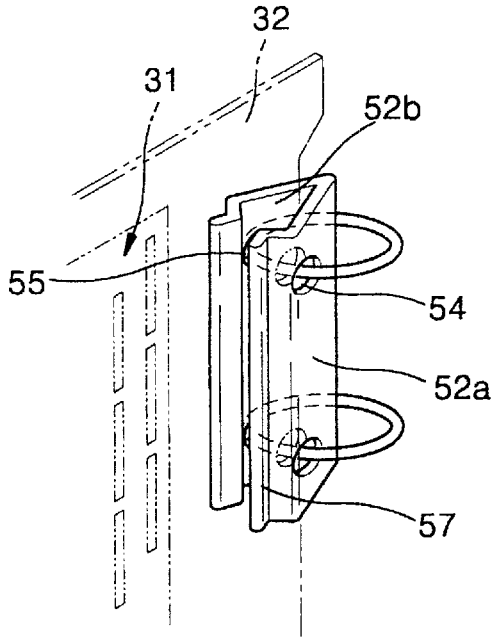
Figure 8:
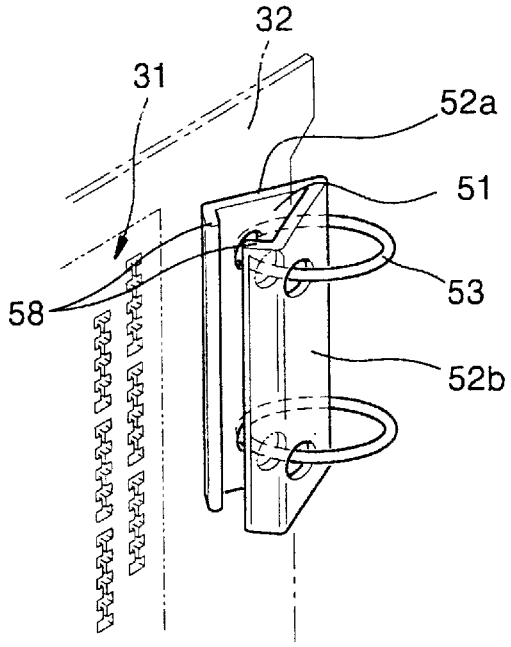

FIGS. 6 through 8 show other embodiments of a vibration prevention unit according to the present invention. As shown in FIG. 6, the first and second attenuation portions 52*a* and 52*b* for forming an insertion portion are formed by folding the damper thin plate lengthwise, and connected to each other by a connection portion 52*c*, resulting in a channel-shaped cross section. Here, the width W of the connection portion 52*c* must be maintained to an extent that the non-slotted portion 32 of the tension mask is inserted into the insertion portion and sufficiently vibrate.

In another embodiment, as seen in FIG. 7, preferably the damper 52 has a bead 57 formed lengthwise at the free end of each of the first and second attenuation portions 52*a* and 52*b*. The bead 57 narrows the entrance width of the insertion portion 51 extending from the end of each of the first and second attenuation portions 52*a* and 52*b* at the entrance side of the insertion portion 51. In another embodiment, the damper 52 has a folded portion 58 folded inward from the free end of each of the first and second attenuation portions 52*a* and 52*b*, as shown in FIG. 8, so that the end of the first attenuation portion 52*a* is adjacent to the end of the second attenuation portion 52*b*. Thus, the first and second attenuation portions 52*a* and 52*b* come near to both sides of the non-slotted portion 32 of the tension mask which is inserted into the insertion portion 51.

Figure 9:
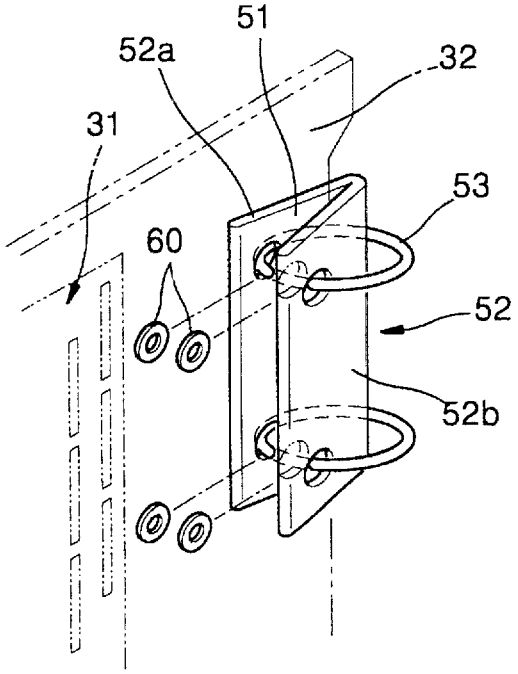
Figure 10:
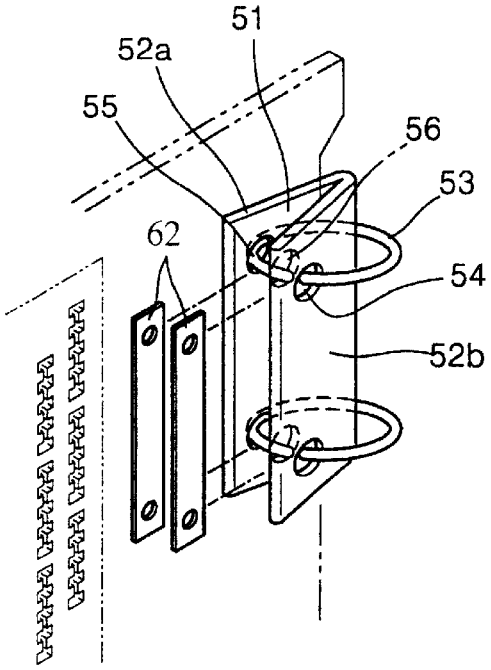

FIGS. 9 and 10 show other embodiments of a vibration attenuation unit according to the present invention. As shown in FIGS. 9 and 10, preferably, at least one of a third attenuation member 60 interposes between one side of the non-slotted portion 32 inserted into the insertion portion of the damper 52 and one of the first and second attenuation portions 52*a* and 52*b* and between the other side of the non-slotted portion 32 and the other attenuation portion and is suspended from the support member 53. The third attenuation member 60 is in the shape of a donut (washer shape) or a rectangle 62 having a length similar to the length of the damper.

Figure 11:
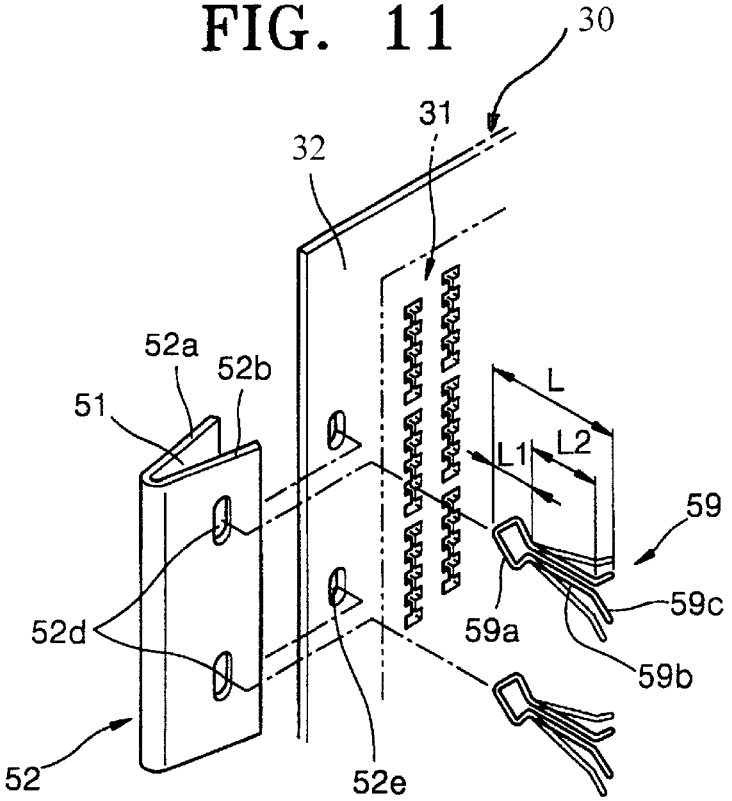

FIG. 11 shows another embodiment of a vibration attenuation unit according to the present invention. As shown in FIG. 11, first slots 52*d* are formed on the first and second attenuation portions 52*a* and 52*b* of the damper 52, and second slots 52*e* that are smaller than the first slots 52*d* are formed in the non-slotted portion 32 of the tension mask which is inserted into the insertion portion 51 formed by the first and second attenuation portions 52*a* and 52*b*. An Ω-shaped (omega-shaped) clip 59 is inserted into the first slots 52*d* of the first and second attenuation portions 52*a* and 52*b* and the second slot 52*e* of the non-slotted portion 32, thereby suspending the damper 52 from the non-slotted portion 32. The Ω-shaped (omega-shaped) clip 59 is made up of a head portion 59*a* having a circular or oval shape and a greater diameter than the first and second slots 52*d* and 52*e*, a straight portion 59*b* extending from the head portion 59*a*, and a leg portion 59*c* which widens by a predetermined angle from the straight portion. Preferably, the length L2 of the straight portion 59*b* of the clip is greater than 0.1 times the length L1 of the head portion 59*a* and less than a length obtained by subtracting the length L1 of the head portion 59*a* from the total length L of the clip. The Ω-shaped clip 59 is inserted into the first and second slots 52*d* and 52*e* by pressing from the straight portions 59*b* or possibly even the leg portions 59*c* so the the pair of straight portions 59*b* are pressed toward each other. The pressing action deforms the head portion 59*a* such that there is a decrease in the width of the head portion 59*a*, allowing the Ω-shaped clip 59 to be inserted through the damper 52 and the tension mask 30. As the straight portions 59*b* are pressed toward each other, the head portion 59*a* is inserted through the first slot 52*d* of the second attenuation portion, through the second slots 52*e* of the tension mask 30, and then through the first slots 52*d* of the first attenuation portion 52*a*. The Ω-shaped clip 59 may be inserted from the other side of the damper 52 also. When the straight portions 59*b* are released, the straight portion 59*b* along with the leg portion 59*c* revert away from each other to stop the Ω-shaped clip 59 from detaching from the damper 52 and the tension mask 30, as seen in FIG. 11. The Ω-shaped clip 59 secures the damper 52 to the tension mask 30 while still allowing a certain movement. When the straight portions 59*b* are released from each other, the head portion 59*a* increases back towards an initial width so that the Ω-shaped clip 59 cannot be pulled from the first attenuation portion 52*a* side to the second attenuation portion 52*b* side. Furthermore, when the straight portions 59*b* are released from each other, the leg portions 59*c* prevent the Ω-shaped clip 59 from being pulled from the second attenuation portion 52*b* toward the first attenuation portion 52*a*.

The type of clip is not limited to this embodiment, and any kind of clip can be used as long as the damper 52 can swing without being interrupted by the clip.

In the operation of the tension mask frame assembly for a color cathode-ray tube according to the present invention having such a configuration, in a state where the first and second support members 41 and 42 are biased toward one another so that the first and second elastic members 43 and 44 for supporting the first and second support members 41 and 42 are elastically deformed, the tension mask 30 is subject to a tensile force in the direction of strips 33 since the longer sides of the tension mask are respectively welded to the securing portions 41*a* and 42*a* of the first and second support members 41 and 42.

The tension mask subjected to a tensile force as described above vibrates due to small external impacts or the sound pressure of a speaker since its shorter sides are not supported by the frame 40. This vibration of the shorter sides edges 31*b* of the tension mask can be attenuated since the edge of the tension mask is secured by the vibration prevention unit 50 made up of the damper 52 and the support member 53. To be more specific, since the damper 52 is relatively heavier than the support member 53, the damper is efficient in attenuating a low frequency vibration having a great amplitude, and the support member is efficient in attenuating a low frequency vibration having a small amplitude.

The vibration attenuation operation will now be described with reference to FIG. 12 by dividing the vibration of the tension mask 30 into a vibration in the length direction Y of strips and a vibration in direction X perpendicular to the length direction of the strips.

Figure 12:
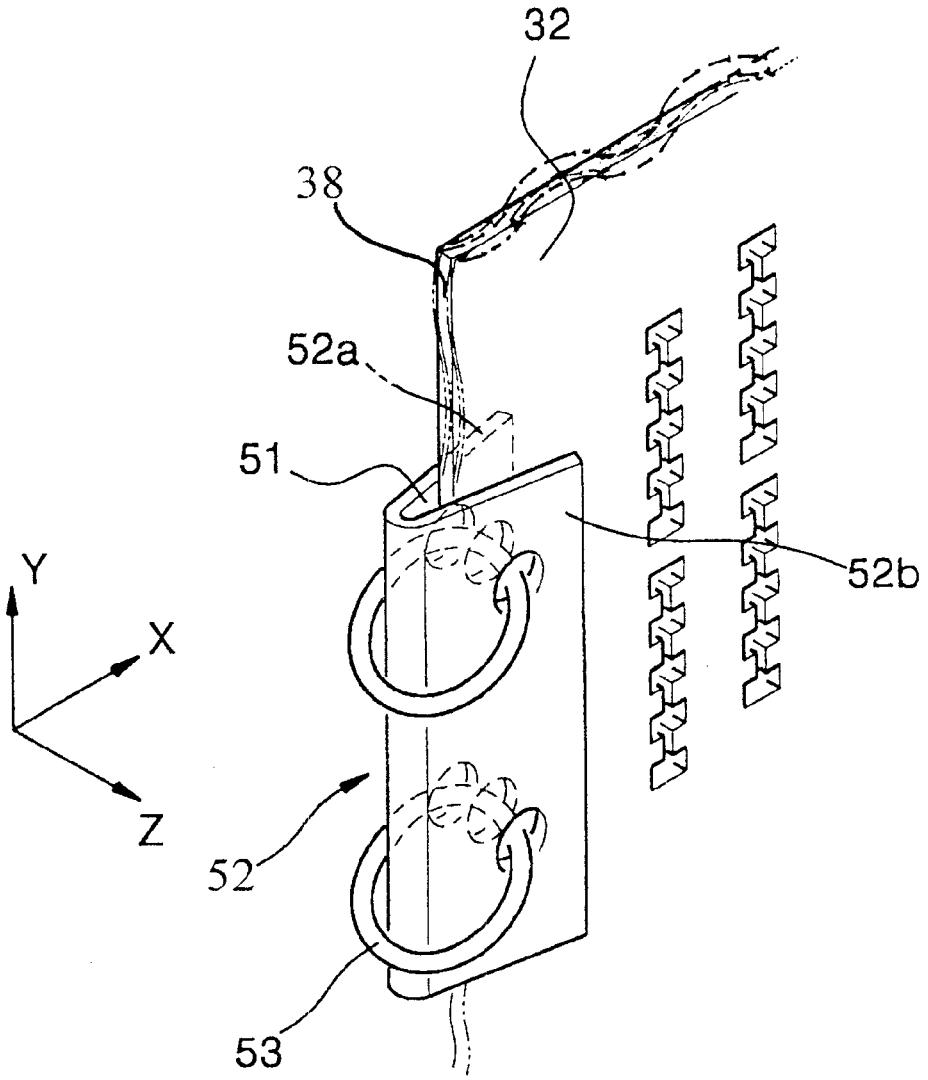
FIG. 12 is a perspective view illustrating the state in which vibrations of a tension mask are prevented by a vibration prevention unit according to the present invention.

Referring to FIG. 12, the vibration having an amplitude in the direction Y of the tension mask is attenuated by a coulomb friction that is proportional to a vertical load. In order to attenuate the vibrations of the tension mask, the load of the damper and the load of the support member are simultaneously applied to the vibrating non-slotted portion, resulting in an improved vibration effect. The damper 52, especially the inner surface of the first and second attenuation portion forming the insertion portion 51, helps in attenuating the vibration in the Y-direction. The contact of the insertion portion 51 with the non-slotted portion 32 of the tension mask attenuates the vibration in the Y-direction. The contact of the insertion portion 51 of the damper 52 with the edge portion 38 of the tension mask attenuates the vibration in the X-direction. The support member 53 not only binds the damper 52 to the tension mask but also attenuates the vibrations in the Y-direction of the tension mask.

As for the vibration of the tension mask non-slotted portion 32, its amplitude vibrates in the direction Z relatively perpendicular to the length direction of the non-slotted portion 32. The distance between the ends of the insertion portion into which the non-slotted portion is inserted is so narrow that the non-slotted portion contacts the sides of the first and second attenuation portions 52*a* and 52*b*, so that the vibration is attenuated.

Figure 13:
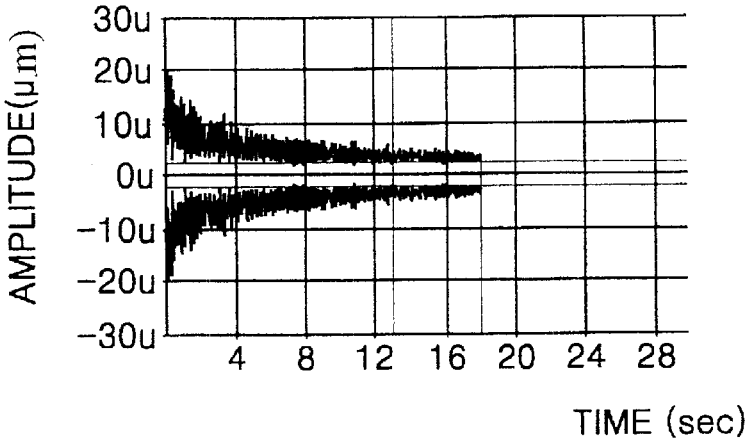
FIG. 13 is a graph showing the vibration attenuation state of a conventional tension mask.
Figure 14:
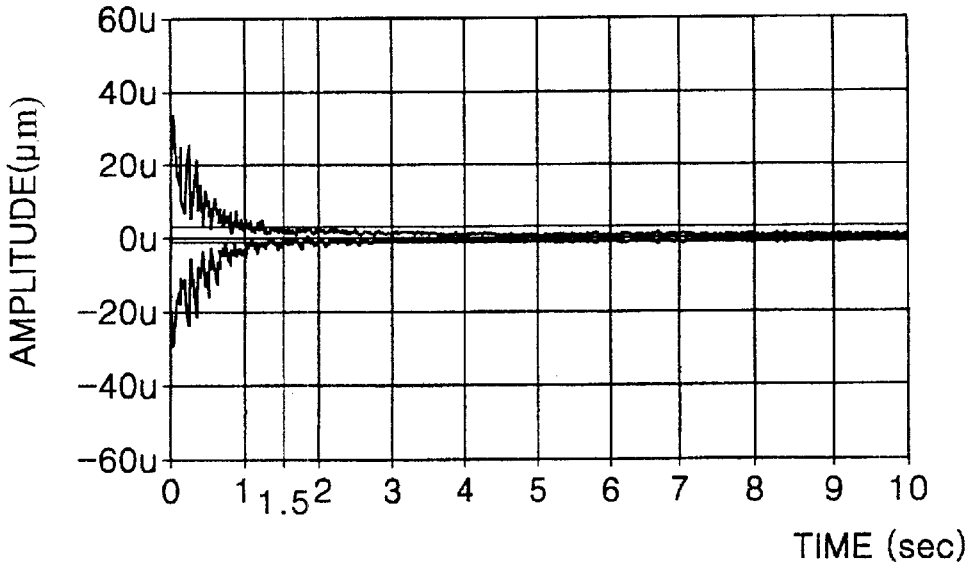
FIG. 14 is a graph showing the vibration attenuation state of a tension mask according to the present invention.

An experiment made by the present inventor measured the time during which the initial maximum amplitude is attenuated to 10% at a position spaced 250 millimeters apart in the direction X from the center of a tension mask on which the distance between the center and the longer side is 300 millimeters. As shown in FIG. 13, in the case of an earlier tension mask, it took 18 seconds or more to attenuate the initial maximum amplitude. However, in the case of a tension mask according to the present invention, it took 1.5 seconds to attenuate the initial maximum amplitude.

In the above-described tension mask frame assembly for a flat cathode-ray tube according to the present invention, a damper suspended from the non-slotted portion of a tension mask by a support member is installed at the ends of first and second support members, thereby preventing vibrations of the tension mask and furthermore preventing picture jitter generated by the vibrations of the tension.

Although the invention has been described with reference to particular embodiments, it will be apparent to one of ordinary skill in the art that modifications of the described embodiments may be made without departing from the spirit and scope of the invention.

What is claimed is:

1. A tension mask frame assembly for a color cathode-ray tube, comprising:

a tension mask including a slotted portion with a plurality of electron beam passing holes formed and a non-slotted portion disposed on the edge of the slotted portion;

a frame supporting two facing sides of the tension mask to apply a tensile force to the tension air mask; and a vibration prevention unit comprising a damper with first and second attenuation portions being maintained at a predetermined angle to form an insertion portion, the insertion portion accommodating the edges of the tension mask not supported by the frame, and a support member suspending the damper from the edges of the tension mask by passing through the first and second attenuation portions and the edges of the tension mask inserted into the insertion portion formed by the first and second attenuation portions.

2. The tension mask frame assembly of claim 1, with the damper being formed by folding a plate-shaped member.

3. The tension mask frame assembly of claim 1, with the insertion portion formed by the first and second attenuation portions of the damper becoming narrower from an entrance of the insertion portion toward an inside of the insertion portion.

4. The tension mask frame assembly of claim 1, further comprising a folded portion being formed by folding the ends at the entrance of the insertion portion formed by the first and second attenuation portions in opposite directions, and narrows the entrance width of the insertion portion.

5. The tension mask frame assembly of claim 1, further comprising a bead narrowing the entrance width of the insertion portion extending from the end of each of the first and second attenuation portions at the entrance side of the insertion portion.

6. The tension mask frame assembly of claim 1, with the inner surfaces of the first and second attenuation portions forming the insertion portion being embossed or knurled.

7. The tension mask frame assembly of claim 1, further comprising a third attenuation member suspending from the support member being installed between the first and second attenuation portions and the non-slotted portion.

8. The tension mask frame assembly of claim 7, with the third attenuation member being formed of a washer or a rectangular plate.

9. The tension mask frame assembly of claim 1, with the bases of the first and second attenuation portions being connected to each other by a connection portion.

10. The tension mask frame assembly of claim 1, with a first hole being formed in each of the first and second attenuation portions of the damper, a second hole being formed on the tension mask, and a clip being coupled to the first and second holes to suspend the damper from the tension mask.

11. The tension mask frame assembly of claim 10, with the clip comprising of a head portion and a pair of straight portions, the pair of straight portions elastically bent away from each other, when the straight portions are pressed toward each other, the head portion is deformed from an initial state to accommodate within the first and second holes to suspend the damper, the release of the straight portions away from each other restores the head portion to the initial state and the straight portion are restored to being bent away from each other, the released head portion and the leg portion accommodate the securing of the damper with the tension mask and providing a certain movement of the damper with the tension mask.

12. The tension mask frame assembly of claim 11, with each of the straight portions extending to a leg portion, each of the leg portions bent away from each other, the leg portions forming a stopper for a lateral disengagement of the clip in one direction within the damper.

13. The tension mask frame assembly of claim 12, with the straight portion being greater than 0.1 times the length of the head portion and less than the length of the head portion subtracted from the total length of the clip.

14. The tension mask frame assembly of claim 10, with the clips being an omega (Ω) shape including a first portion and a second portion, a pressing of the second portion accommodating the insertion of the clip into the damper and the tension mask to suspend the damper from the edge of the tension mask, a release of the second portion preventing the clip from disengaging the clip from the damper and the tension mask.

15. The tension mask frame assembly of claim 1, with the support member having a shape of a ring.

16. The tension mask frame assembly of claim 1, with the support member comprising of a head portion having a greater diameter than holes penetrating the first and second attenuation portions of the damper and the edge of the tension mask, a straight portion extending from the head portion, and a leg portion formed at the terminal of the straight portion.

17. The tension mask frame assembly of claim 1, with the damper attenuating vibration in X and Y direction in the tension mask and the support member attenuating vibration in the Y direction in the tension mask, the Y direction being parallel with edge of the tension mask accommodated by the vibration prevention unit, the X direction being perpendicular to the Y direction and parallel with the tension mask.

18. The tension mask frame assembly of claim 1, with the vibration prevention unit attenuating vibration in X and Y direction in the tension mask, the Y direction being parallel with edge of the tension mask accommodated by the vibration prevention unit, the X direction being perpendicular to the Y direction and parallel with the tension mask.

19. A tension mask frame assembly for a color cathode-ray tube, comprising:

a frame including first and second support members isolated from each other at a predetermined interval and at least a pair of elastic members, the ends of the elastic members being secured to the first and second support members, for supporting the first and second support members;

a tension mask having a plurality of strips isolated from each other at a predetermined interval for forming slots and a plurality of real bridges installed between adjacent strips for partitioning a slot by connecting the adjacent strips to each other, the longer sides of the tension mask perpendicular to the length direction of the strips are supported by the first and second support members accommodating a tensile force being applied to the plurality of strips; and a vibration prevention unit including a damper having first and second attenuation portions located at both sides of the edge of the tension mask for forming an insertion portion, the edge of the tension mask being inserted into the insertion portion, and a support member suspending the damper from a non-slotted portion of the tension mask, the support member being inserted into the insertion portion by passing through the first and second attenuation portions and a non-sloted portion of the tension mask.

20. The tension mask frame assembly of claim 19, with the damper being formed by folding a plate-shaped member.

21. The tension mask frame assembly of claim 19, with the insertion portion formed by the first and second attenuation portions of the damper becoming narrower from an entrance of the insertion portion toward an inside of the insertion portion.

22. The tension mask frame assembly of claim 19, further comprising a folded portion as being formed by folding the ends at the entrance of the insertion portion formed by the first and second attenuation portions in opposite directions, and narrows the entrance width of the insertion portion.

23. The tension mask frame assembly of claim 19, further comprising a bead narrowing the entrance width of the insertion portion extending from the end of each of the first and second attenuation portions at the entrance side of the insertion portion.

24. The tension mask frame assembly of claim 19, with the inner surfaces of the first and second attenuation portions forming the insertion portion being embossed or knurled.

25. The tension mask frame assembly of claim 19, further comprising a third attenuation member suspending from the support member being installed between the first and second attenuation portions and the non-slotted portion.

26. The tension mask frame assembly of claim 19, with the support member having a shape of a ring.

27. The tension mask frame assembly of claim 19, with the support member comprising of a head portion having a greater diameter than holes penetrating the first and second attenuation portions of the damper and the edge of the tension mask, a straight portion extending from the head portion, and a leg portion formed at the terminal of the straight portion.

* * * * *

UNITED STATES PATENT AND TRADEMARK OFFICE

CERTIFICATE OF CORRECTION

PATENT NO. : 6,590,328 B2
DATED : July 8, 2003
INVENTOR(S) : Soon-Cheol Shin et al.

It is certified that error appears in the above-identified patent and that said Letters Patent is hereby corrected as shown below:

Title page,
Item [73], Assingee, change the Assignee's name to -- Samsung SDI Co., Ltd. --.

Signed and Sealed this

Thirtieth Day of December, 2003

JAMES E. ROGAN
*Director of the United States Patent and Trademark Office*